United States Patent [19]

Baldwin

[11] 4,280,170

[45] Jul. 21, 1981

[54] LUMINAIRE

[75] Inventor: Samuel L. Baldwin, East Flat Rock, N.C.

[73] Assignee: General Electric Company, Schenectady, N.Y.

[21] Appl. No.: 78,964

[22] Filed: Sep. 26, 1979

[51] Int. Cl.[3] ..... F21S 3/00

[52] U.S. Cl. ..... 362/224; 362/308; 362/309; 362/368

[58] Field of Search ..... 362/224, 308, 309, 368

[56] References Cited

U.S. PATENT DOCUMENTS 4,186,433 1/1980 Baldwin ..... 362/404

*Primary Examiner*—Stephen J. Lechert, Jr.

*Attorney, Agent, or Firm*—Sidney Greenberg; Lawrence R. Kempton; Philip L. Schlamp

[57] ABSTRACT

Indoor lighting fixture provides semi-indirect symmetrical light distribution. The fixture comprises a central support tube attached to the ceiling at its upper end and having a high intensity gaseous discharge lamp at its lower end projecting into a box-like housing having a semi-transparent variable transmission lens on its bottom and an interior reflector extending around the lamp for reflecting light rays upwardly toward the ceiling. Vertically spaced louvers arranged encircling the upper portion of the lamp serve to shield the lamp from direct view of the room occupants to avoid glare.

11 Claims, 6 Drawing Figures

18c
18a
18b 16
12
13
13
11
10
17
5
14
6a
18
18a
3
3a
1a
4
15a
6
4
1
15b
15
3b
2
3b

Fig. 2
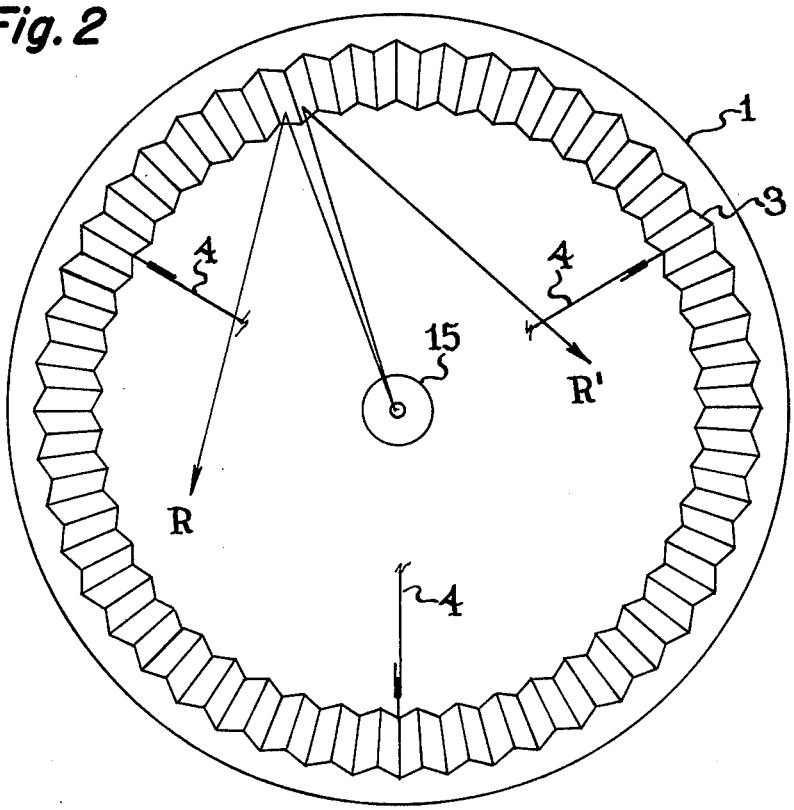
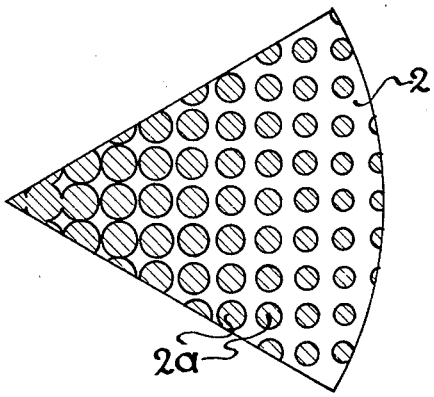
Fig. 5

LUMINAIRE

The present invention relates to luminaires, and more particularly concerns indoor lighting fixtures adapted to be hung from a ceiling for producing semi-indirect light distribution in a room.

With the advent of light sources having efficacies higher than fluorescent lamps, such as high pressure sodium vapor and metal halide (high intensity) gaseous discharge lamps (HID lamps), it is contemplated that such high intensity lamps will find substantially increased use for indoor applications such as in offices, classrooms and store merchandizing areas. There is an economic advantage in using especially the higher wattage lamps of this type, due to the greater efficiency, the reduced number of lighting fixtures required to illuminate a given area, and the consequent reduction in the time necessary for installation and maintenance of a lighting system comprising such fixtures. However, the brightness of the lighting fixture is usually too great when such higher wattage lamp are used in the conventional types of luminaires.

It is an object of the invention to provide an improved indoor luminaire using a high intensity gaseous discharge lamp.

It is a particular object of the invention to provide a luminaire of the above type which is adapted to be mounted below a ceiling and arranged so that the light emanating therefrom is principally directed toward the ceiling for indirect lighting of the room or the work area below and a lesser amount of light is transmitted directly below the luminaire.

Still another object of the invention is to provide a luminaire of the above type wherein the light source is shielded from the observer to avoid glare.

Other objects and advantages will become apparent from the following description and the appended claims.

With the above objects in view, the present invention in one of its aspects relates to a luminaire adapted to be suspended from a ceiling or the like for semi-indirect illumination of a work area below the ceiling comprising, in combination, an elongated support member adapted to be secured at its upper end to the ceiling, a housing suspended from the support member and arranged below the lower end thereof, the housing having a side wall defining an open top and having a bottom comprising semi-transparent lens means, elongated lamp means removably attached to the lower end of the support member and extending with its lower portion into the housing, the housing having reflector means within its side wall extending around the lower portion of the lamp means, the reflector means reflecting direct light rays from the lamp means upwardly and outwardly from the housing toward the ceiling principally in paths between the lamp means and the side wall, the semi-transparent lens means reflecting upwardly toward the ceiling a portion of the direct light rays incident thereon and transmitting downwardly therethrough substantially the remainder of the incident light rays.

The invention will be better understood from the following description taken in conjunction with the accompanying drawings in which:

FIG. 1 is a view in elevation, partly in section, of a luminaire constructed in accordance with the invention;

FIG. 1*a* is a perspective view of a louver member employed in the light shielding device of the FIG. 1 luminaire;

FIG. 2 is a top plan view of the reflector in the luminaire shown in FIG. 1;

FIG. 5 is a plan view of a portion of the variable transmission lens of the luminaire.

Figures 1, 1A:
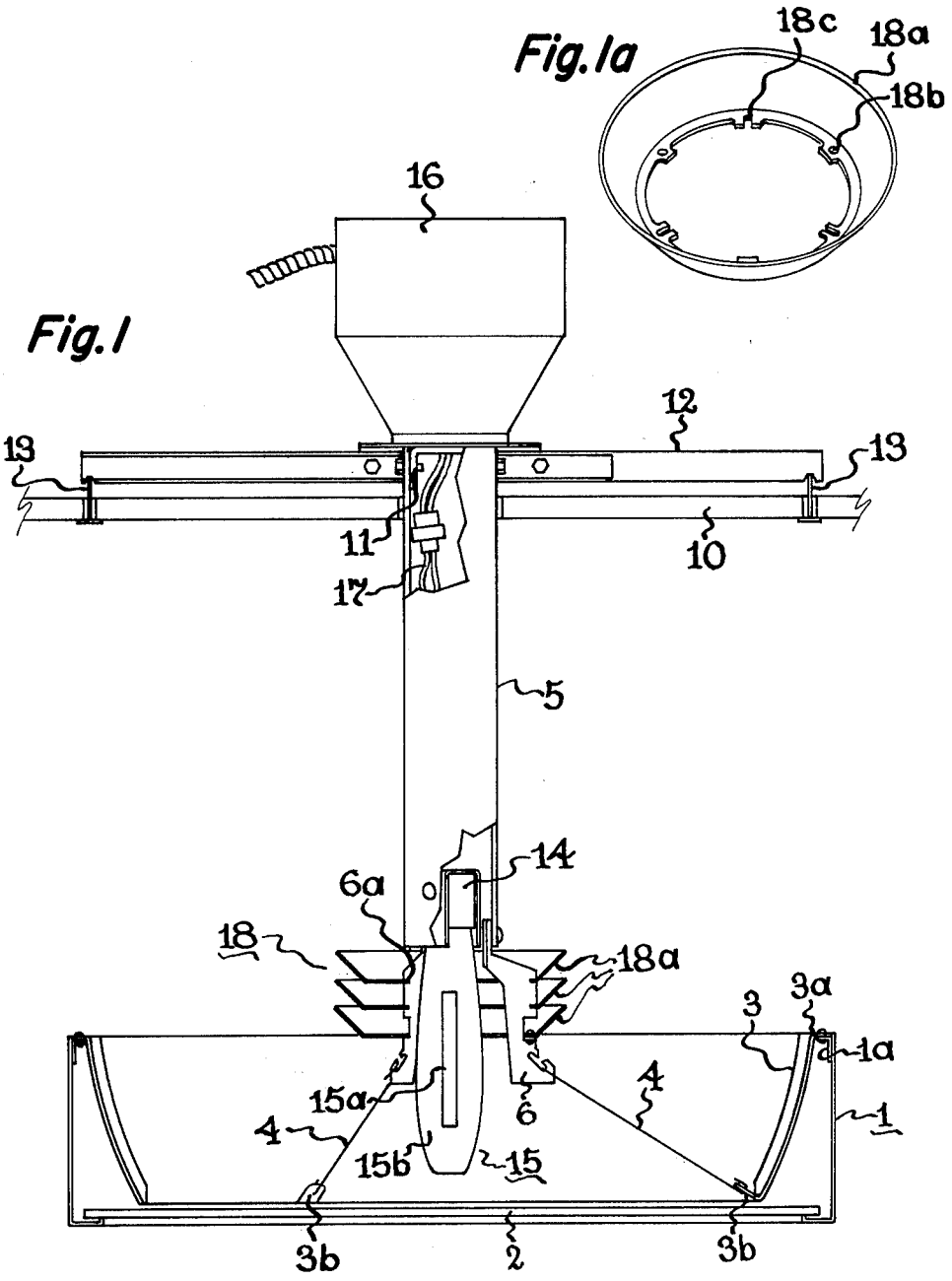

Referring now to the drawings, and particularly to FIG. 1, there is shown a luminaire comprising a circular box-like housing 1 having an open top and a bottom closure comprising a semi-transparent lens 2. Arranged extending along the interior of the opaque side wall of housing 1 and fixed thereto is an annular reflector 3 having a structure as described below. Housing 1 is suspended from an elongated tubular support 5 by a plurality of circumferentially spaced support hangers 4 such as metal rods, wires, or the like, typically three in number, which are attached by hooks at their lower ends to perforated tabs 3*b* arranged around the bottom of reflector 3 and at their top ends to correspondingly arranged brackets 6 secured to the bottom of tubular support 5. The arrangement is such that housing 1 is spaced below the bottom of tubular support 5 and is coaxial therewith. At its top end, tubular support 5 is secured to ceiling 10 by means of bracket 11 secured to frame assembly 12 which rests on ceiling grid supports 13. At its bottom end tubular support 5 has a lamp socket 14 secured thereto, in which elongated discharge lamp 15 is removably mounted and extends with its lower portion into the interior of housing 1. Lamp 15 is typically a high intensity gaseous discharge lamp, such as a high pressure sodium or metal halide lamp, and comprises an inner arc tube 15*a* enclosed in an outer transparent envelope 15*b*.

Mounted on frame assembly 12 above ceiling 10 is ballast housing 16 containing electrical ballast components (not shown) for operating lamp 15, the ballast components being connected to the lamp by conductors 17 which pass through the interior of tubular support 5.

Light shielding device 18, which in the illustrated embodiment comprises a plurality of annular conical louver members 18*a* in superposed coaxial relation, is arranged surrounding the upper portion of lamp 15 in the space between tubular support 5 and the top of housing 1. As seen in FIG. 1*a*, each louver member 18*a* is formed at its bottom edge with circumferentially spaced apertured tabs 18*b* and notched lugs 18*c*. In the louver assembly 18 shown in FIG. 1, the lowermost louver member is secured to bracket 6 by rivets or the like which pass through the apertured tab 18*b* and a mating apertured flange on bracket 6. The remaining louver members 18*a* are supported in the illustrated positions by engagement of their notched lugs 18*c* in vertically spaced recesses 6*a* in the edge of brackets 6. The arrangement is preferably such that the bottom edge of each louver member 18*a* is approximately at the level of the top edge of the next lower louver member, so that the lamp is shielded from an observer viewing the lamp from a position at or below the level of the louver device. The inner (upper) surface of each louver member 18*a*, preferably has a highly reflective surface, while the outer (lower) surface is provided with a low reflectance glossy finish such as a black enamel paint.

In the embodiment illustrated in FIGS. 1 and 2, reflector 3 is annular in form with concave sides sloping downwardly and inwardly and being substantially circular in horizontal and vertical sections. Reflector 3 is secured to the side wall of housing 1 by means of rim flange 3*a* which overlies and is fastened to angle bracket 1*a* attached at the top of the housing side wall. As seen in FIG. 2, the inner surface of reflector 3 is in the form of vertically elongated reflecting facets arranged side by side about the axis of reflector 3, with adjacent facets being at an angle to one another so as to form alternating ridges and grooves between the adjoining sides of the facets. The facet surfaces may be flat, or may be convex as disclosed in the patent to Osteen et al U.S. Pat. No. 3,662,165, issued May 9, 1972 and assigned to the same assignee as the present invention, or may be concave. By virtue of the disclosed facet arrangement, the light rays incident on reflector 3 from lamp 15 will be reflected on opposite sides of the lamp, as seen in FIG. 2, depending on which side of the ridge or groove between facets they strike, with little or no light being reflected directly back to the light source. As indicated previously, reflector 3 in vertical section is typically circular, with a radius substantially greater than the radius of the top of the reflector and having a center of curvature above the top of the housing. However, the reflector may have a curvature in vertical section other than circular, such as parabolic or elliptical, or combinations thereof.

Mounted in housing 1 covering the open bottom thereof is semi-transparent plate or lens 2, such as an acrylic or glass sheet, which extends across the open bottom of reflector 3. Lens 2 has a structure designed to control the proportion of light reflected therefrom and transmitted therethrough in accordance with the purposes of the invention. Ordinarily, it is desirable to provide for about 10% to 30% of the total lamp flux to be distributed from the light source through lens 2 to the work area below the fixture. To this end, white pigment is incorporated in the lens to increase its reflectance while reducing the transmitted light. In addition, a pattern of spots or lines of reflective paint is provided on the upper surface of lens 2, wherein the pattern is denser in the central portion of the lens and is of decreasing density from the central portion to the outer edges of the lens. FIG. 5 shows a portion of lens 2 with a pattern of dots 2*a* thereon, the dots being larger and closer together in the central region, and smaller and spaced farther apart toward the outer region. Such a pattern results in less light transmission in the central region where the lamp is closer to lens 2, and increasingly greater light transmission toward the outer edges. As a result, the lens when observed from normal viewing angles below the fixture appears to have substantially uniform luminance (brightness) across the lens surface. Various methods may be employed for applying the pattern on the lens, such as silk screening, hot stamping, and spray masking.

To provide for diffusion of the light rays passing through lens 2, the bottom surface of the lens may be prismatic or textured, as well understood in the art.

Figure 3:
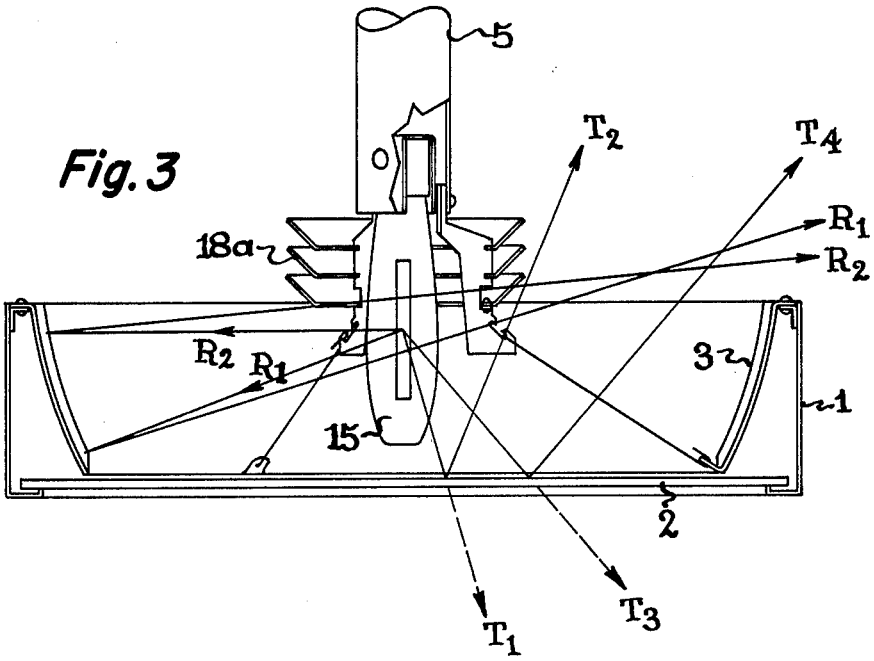
FIG. 3 is a view similar to FIG. 1 showing the path of light rays reflected and transmitted in the luminaire.

As seen in FIG. 3, a portion of the light from lamp 15 incident on reflector 3, as represented by light rays $R_1$ and $R_2$, is directed toward the ceiling, where it is redirected downwardly toward the room area to be illuminated.

The light from lamp 15 which is incident on lens 2 is partly reflected upwardly as shown by rays $T_2$ and $T_4$, while the remainder is transmitted through lens 2, as shown by rays $T_1$ and $T_3$, downwardly to the room area below the fixture, the relative amounts of the thus reflected and transmitted light being proportioned as described previously.

Figure 4:
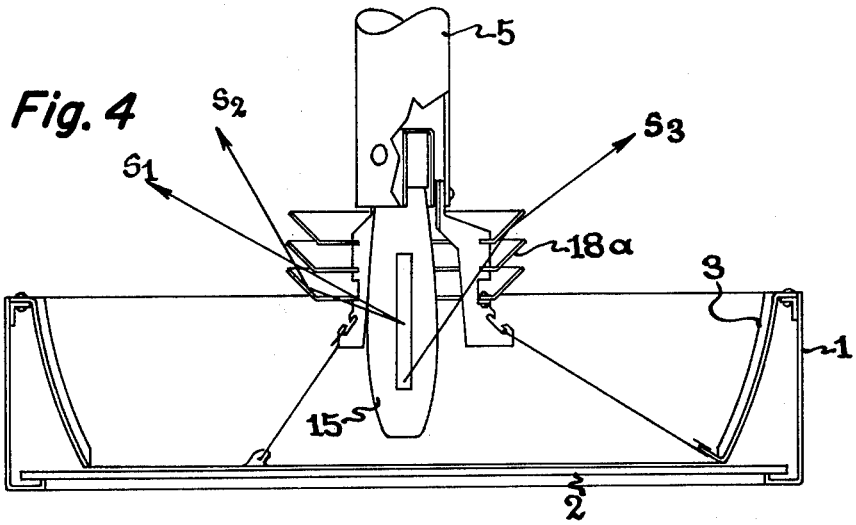
FIG. 4 is a view similar to FIG. 3 showing the path of light rays through the light-shielding louvers of the luminaire.

As seen in FIG. 4, light rays emanating upwardly from lamp 15 are variously directed depending on whether they strike the louvers 18*a* or what portions thereof they strike. Thus, light ray $S_1$ passes upwardly from the lamp between adjacent louvers 18*a* toward the ceiling. Light ray $S_2$ is incident on the inner, highly reflective surface of louver 18*a*, from which it is directed upwardly toward the ceiling. Light ray $S_3$ is intercepted by the lower surface of the louver at a grazing angle, so that a portion of the incident light is reflected upwardly by the glossy black paint on that surface while the remainder is substantially absorbed by the black paint. As a result of the described arrangement, substantially no light from that portion of lamp 15 between support 5 and housing 1 is directed downwardly to cause glare in the eyes of the room occupants.

Figure 6:
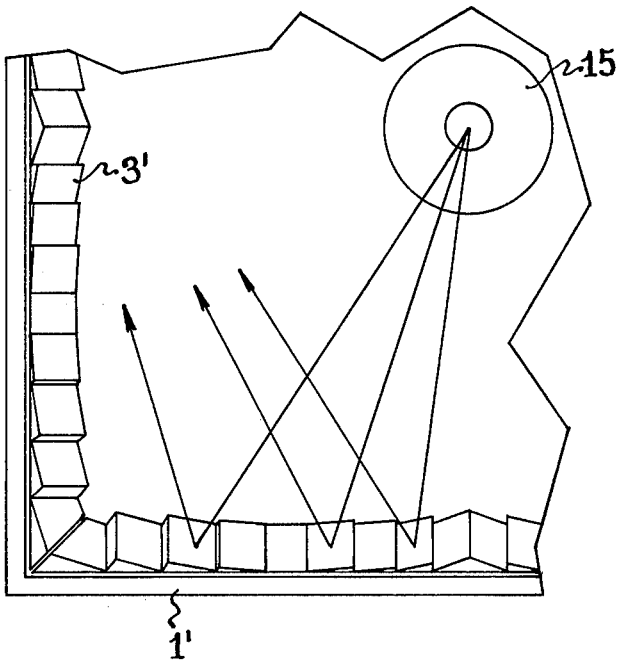
FIG. 6 is a plan view of a portion of a modified form of the housing and reflector of the FIG. 1 luminaire.

FIG. 6 is a plan view of a portion of a modified form of luminaire housing 1' which is square, rather than round as in the FIG. 1 embodiment. Reflector 3' comprises four side panels each comprising two sections of stepped reflector surfaces. The reflector surfaces are in radially stepped form in order to have the reflector conform closely to the walls of housing 1', so as to reduce shadows on lens 2. Preferably, the reflector surfaces are elliptical in both horizontal and vertical section, the curvature being such that the degree of convergence of the reflected light rays, as shown in FIG. 6, is substantially equal to the degree of divergence of the light rays incident on the reflector section from lamp 15, that is, about 45° in the illustrated embodiment, with the result that the light rays from the various sections of the reflector strike the ceiling in a relatively uniform distribution of light. The reflector elements may, however, be of parabolic or circular shape, if desired.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A luminaire adapted to be suspended from a ceiling or the like for semi-indirect illumination of a work area below the ceiling comprising, in combination, an elongated support member adapted to be secured at its upper end to the ceiling, a housing suspended from said support member and arranged below the lower end thereof, said housing having a side wall defining an open top and having a bottom comprising semi-transparent lens means, elongated lamp means removably attached to the lower end of said support member and extending with its lower portion into said housing, said housing having reflector means within its side wall extending around the lower portion of said lamp means, said reflector means reflecting direct light rays from said lamp means upwardly and outwardly from said housing toward the ceiling principally in paths between said lamp means and said side walls, said semi-transparent lens means reflecting upwardly toward the ceiling a portion of the direct light rays incident thereon and transmitting downwardly therethrough substantially the remainder of said incident light rays, said reflector means comprising an annular opaque reflector arranged closely adjacent and substantially co-extensive with said housing side wall.

2. A luminaire as defined in claim 1, said reflector being formed of facets arranged at an angle to one another for reflecting light rays from said lamp means away from said lamp means.

3. A luminaire as defined in claim 1, including light shielding means arranged extending around said lamp means between the bottom of said support member and the top of said housing.

4. A luminaire as defined in claim 3, said light shielding means comprising a plurality of superposed spaced louver members.

5. A luminaire as defined in claim 1, said lamp comprising a light source and a transparent envelope enclosing said light source.

6. A luminaire as defined in claim 1, said lens means having variable light transmission means on its surface for transmitting increasing amounts of light from its center toward its periphery.

7. A luminaire as defined in claim 1, said elongated support member being tubular, said lamp means comprising a high intensity gaseous discharge lamp, socket means arranged within the lower portion of said tubular support member for removably holding said gaseous discharge lamp, ballast housing means arranged at the top of said tubular support member, and electrical conductor means extending through said tubular support member between said socket means and said ballast housing.

8. A luminaire as defined in claim 1, said housing formed of a substantially circular opaque side wall, said reflector means being annular and arranged coaxial with said side wall.

9. A luminaire as defined in claim 8, said reflector means being substantially circular in vertical and horizontal section.

10. A luminaire as defined in claim 1, said housing side wall being rectangular, said reflector means comprising radially stepped surface portions arranged closely adjacent said rectangular housing side wall.

11. A luminaire as defined in claim 10, said reflector surface portions being elliptical in horizontal and vertical section.

* * * * *